US008813410B2

(12) United States Patent
Jung et al.

(10) Patent No.: US 8,813,410 B2
(45) Date of Patent: Aug. 26, 2014

(54) DOT-SIGHTING DEVICE

(71) Applicants: In Jung, Bucheon-si (KR); Bo Sun Jeung, Bucheon-si (KR)

(72) Inventors: In Jung, Bucheon-si (KR); Bo Sun Jeung, Bucheon-si (KR); Dong Hee Lee, Seongnam-si (KR)

(73) Assignees: In Jung, Bucheon-si (KR); Bo Sun Jeung, Bucheon-si (KR)

( * ) Notice: Subject to any disclaimer, the term of this patent is extended or adjusted under 35 U.S.C. 154(b) by 0 days.

(21) Appl. No.: 13/860,140

(22) Filed: Apr. 10, 2013

(65) Prior Publication Data

US 2014/0096428 A1 Apr. 10, 2014

(30) Foreign Application Priority Data

Oct. 10, 2012 (KR) ..... 10-2012-0112685
Feb. 26, 2013 (KR) ..... 10-2013-0020468

(51) Int. Cl.
*F41G 1/30* (2006.01)

(52) U.S. Cl.
USPC ..... 42/113; 89/41.19; 356/247; 396/140

(58) Field of Classification Search
USPC ..... 42/111, 113; 356/247, 251–255, 6, 9; 396/138, 140
See application file for complete search history.

(56) References Cited

U.S. PATENT DOCUMENTS 2,190,567 A 2/1940 Jung
2,190,569 A 2/1940 Macgill
2,419,151 A 4/1947 Miles
2,986,972 A 6/1961 Miles
3,524,710 A 8/1970 Rickert
3,672,782 A 6/1972 Akin, Jr.
3,867,764 A 2/1975 Dunmire et al.
3,914,030 A 10/1975 Weiss
3,963,356 A 6/1976 Wiklund
4,269,476 A 5/1981 Gauthier et al.
4,417,814 A * 11/1983 Doliber ..... 356/252
4,600,271 A 7/1986 Boyer et al.
4,704,018 A 11/1987 Takhashi
4,764,011 A 8/1988 Goldstein
5,205,044 A 4/1993 DePaoli
5,272,514 A 12/1993 Dor (Continued)

FOREIGN PATENT DOCUMENTS

CH 619296 A5 9/1980
EP 0239700 A2 10/1987

(Continued)

OTHER PUBLICATIONS

International Search Report issued Sep. 28, 2012 in corresponding application No. PCT/KR2012/001626, 6 pages.

*Primary Examiner* — Benjamin P Lee
(74) *Attorney, Agent, or Firm* — Baker & McKenzie LLP

(57) ABSTRACT

A dot-sighting device includes a light source, a beam splitter and a reflective element. The light source emits light. The beam splitter includes a surface that reflects at least a portion of a first light component of the light and transmits at least a portion of a second light component. The reflective element reflects at least a portion of the first light component reflected by the surface of the beam splitter toward the beam splitter. The light reflected by the reflective element includes the second light component.

22 Claims, 3 Drawing Sheets

(56) References Cited

U.S. PATENT DOCUMENTS

| | | | | |
|---|---|---|---|---|
| 5,373,644 | A | 12/1994 | DePaoli | |
| 5,493,450 | A | 2/1996 | Ekstrand | |
| 5,508,843 | A | 4/1996 | Tomita | |
| 5,532,875 | A | 7/1996 | Betensky | |
| 5,625,954 | A | 5/1997 | DePaoli | |
| 5,777,797 | A | 7/1998 | Miyano | |
| 5,813,159 | A | 9/1998 | Kay et al. | |
| 6,295,754 | B1 | 10/2001 | Otteman et al. | |
| 6,327,806 | B1 | 12/2001 | Paige | |
| 6,967,775 | B1 | 11/2005 | Millett | |
| 7,145,703 | B2 | 12/2006 | Sieczka et al. | |
| 7,234,265 | B1 | 6/2007 | Cheng et al. | |
| 7,333,270 | B1 * | 2/2008 | Pochapsky et al. | 359/634 |
| 7,872,747 | B2 * | 1/2011 | Gerlach | 356/251 |
| 7,997,163 | B2 | 8/2011 | Casas | |
| 8,020,335 | B2 | 9/2011 | Larsson et al. | |
| 8,474,173 | B2 * | 7/2013 | Matthews et al. | 42/130 |
| 2002/0186476 | A1 | 12/2002 | Sasano et al. | |
| 2009/0168057 | A1 * | 7/2009 | Gerlach | 356/251 |
| 2012/0102808 | A1 * | 5/2012 | Matthews et al. | 42/113 |
| 2012/0106170 | A1 * | 5/2012 | Matthews et al. | 362/311.06 |
| 2013/0263491 | A1 * | 10/2013 | Jung et al. | 42/113 |

FOREIGN PATENT DOCUMENTS

| | | | |
|---|---|---|---|
| JP | 03-191389 | A | 8/1991 |
| KR | 10-0667472 | | 1/2007 |
| KR | 10-0921308 | | 10/2009 |

* cited by examiner

DOT-SIGHTING DEVICE

CROSS-REFERENCE TO RELATED APPLICATIONS

This application claims priority to Korean Application Nos. 10-2012-0112685, filed on Oct. 10, 2012, and 10-2013-0020468, filed on Feb. 26, 2013, each of which are hereby incorporated by reference in their entirety.

BACKGROUND

The present application relates generally to a dot-sighting device with a beam splitter.

The performance of rifles or heavy machine guns depends on how fast an aimed shot is accurately fired. Generally, rifles or heavy machine guns (hereinafter, referred to as collectively a "gun") are aimed by aligning the sight positioned on the body thereof with the front sight positioned on the muzzle thereof. When a target is aimed by aligning the sight with the front sight, the user is likely to accurately fire the gun though it depends on the user's skill whether or not the target is accurately hit.

However, when the gun slightly vibrates or is slightly shaken, it is difficult to align a line of sight using the sight and the front sight, and it is difficult to rapidly aim a target at a short distance or in an urgent situation.

In this aiming and firing method, not only is a complicated aiming process of capturing and checking a target and aligning a line of sight required, but also it takes time. Particularly, since the sight and the front sight are too small and sensitive, it is difficult for the user to align the sight with the front sight when even slight vibration occurs. Further, when the user excessively pays attention to alignment of a line of sight, the user's eyes are focused on the sight and the front sight rather than a situation occurring in front, and thus the user's field of view necessary to fire or deal with an urgent situation is narrowed.

In order to resolve difficulty in aligning a line of sight and improve the aiming accuracy, a sighting device with a telescopic lens has been proposed. However, a high-power optical sighting device with a telescopic lens is sensitive even to slight vibration, and thus it is not easy to rapidly aim.

In this regard, a dot-sighting device configured such that an optical sighting device employs a no-power lens or a low-power lens and uses an aiming point without a line of sight has been proposed.

The optical dot-sighting device with the no- or low-power lens helps the user rapidly aim a target and is useful at a short distance or in an urgent situation. Specifically, a time necessary to align a line of sight can be reduced, and since the user has only to match a dot reticle image with a real target, the user can be given a time enough to secure a field of vision. Thus, a target can be aimed rapidly and accurately, and a field of vision necessary to determine a surrounding situation can be secured.

However, in such a dot-sighting device, an optical axis of a reflective mirror is inclined to an optical axis of a barrel of the dot-sighting device and parallax is larger than in an optical system in which an optical axis of a reflective mirror matches an optical axis of a main tube. Further, in order to secure a region within allowable parallax, a distance between the dot reticle and the reflective mirror needs to be further increased, and the effective diameter of the reflective mirror needs to be further reduced.

In the dot-sighting device illustrated in FIG. 1, a dot reticle generating unit 5 is positioned not to hinder movement of light reflected from a reflective mirror 7. Light irradiated by the dot reticle generating unit 5 is not seen from the outside, and thus the user of the dot-sighting device is not noticed by an opponent party. To this end, the optical axis of the reflective mirror has to be inclined with respect to a principal ray (which is generally at the center among light rays and matches an optical axis of the dot-sighting device) which is a representative ray of light reflected from reflective mirror and forms a dot (an image of a dot reticle formed by the reflective mirror) at a predetermined angle (an angle A1 in FIG. 2A). Here, the angle A1 is ½ of an angle A2 formed by a path through the principal ray emitted from the dot reticle generating unit 5 is reflected by the reflective mirror 7 and moves along the optical axis of the dot-sighting device.

In this case, since the reflective mirror is arranged to be inclined to the optical axis of the dot-sighting device (FIG. 2A), large finite ray aberration occurs and affects parallax of a dot observed by the user. Thus, when the size (diameter) of the reflective mirror is assumed to be equal to the distance from the dot reticle generating unit 5 to the reflective mirror 7, the arrangement (FIG. 2A) of the reflective mirror 7 inclined to the optical axis of the dot-sighting device is larger in parallax than the arrangement (FIG. 2B) of the reflective mirror 7 that is not inclined to the optical axis of the dot-sighting device.

The large parallax is likely to increase an error on an initial alignment status among the optical axis of the dot-sighting device, a bullet firing axis of a gun barrel, and a target point as the user's visual axis on the firing target point in the reflective mirror deviates from the optical axis of the dot-sighting device and stays at the periphery of the reflective mirror.

Further, since the parallax increases as the distance between the dot reticle generating unit 5 and the reflective mirror 7 decreases, the structure illustrated in FIG. 2B is smaller in parallax than the structure illustrated in FIG. 2A. Thus, in the structure illustrated in FIG. 2B, the distance between the dot reticle generating unit 5 and the reflective mirror 7 can be reduced to be smaller than in the structure illustrated in FIG. 2A to the extent that the parallax occurs at the same level as in the structure illustrated in FIG. 2A, and thus the size of the dot-sighting device can be reduced.

However, in spite of the above advantages, in the structure illustrated in FIG. 2B, since the dot reticle generating unit 5 is positioned at the center of the barrel of the dot-sighting device, observation of an external target point is hindered, and it is difficult to rapidly aim the target. In addition, light generated from the dot reticle generating unit 5 is observed from the external target point or the opponent party around it, and thus the position of the user of the dot-sighting device is likely to be exposed to the opponent part.

BRIEF SUMMARY

In an embodiment, a dot-sighting device includes a light source, a beam splitter and a reflective element. The light source emits light. The beam splitter includes a surface that reflects at least a portion of a first light component of the light and transmits at least a portion of a second light component. The reflective element reflects at least a portion of the first light component reflected by the surface of the beam splitter toward the beam splitter. The light reflected by the reflective element includes the second light component.

In another embodiment, a dot-sighting device includes a light source, a reflective element and an optical system. The light source emits light. The reflective element reflect light. The optical system reflects at least a portion of the light emitted from the light source and transmits at least a portion of the light reflected by the reflecting element. An optical axis of the optical system is substantially parallel to an optical axis of the reflecting element.

DETAILED DESCRIPTION OF THE EMBODIMENT(S)

Hereinafter, preferred embodiments will be described in detail with reference to the drawings. Note that, in this specification and the drawings, elements that have substantially the same function and structure are denoted with the same reference signs, and repeated explanation is omitted.

The present application describes, among other things, a dot-sighting device with a beam splitter capable of minimizing parallax.

An exemplary dot-sighting device includes a beam splitter and is capable of preventing a dot reticle light from being observed by an opponent party around an external part.

First of all, a dot-sighting device with a beam splitter according to a first embodiment will be described.

Figure 1:
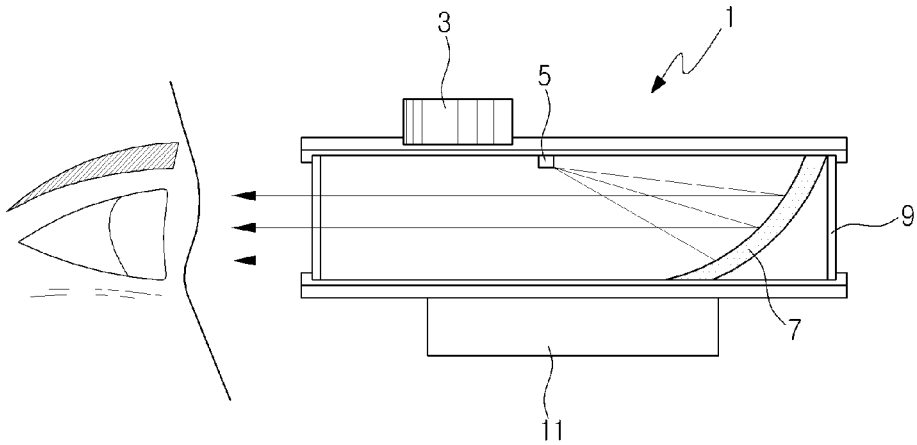
FIG. 1 is a cross-sectional diagram schematically illustrating a dot-sighting device.
Figure 2A:
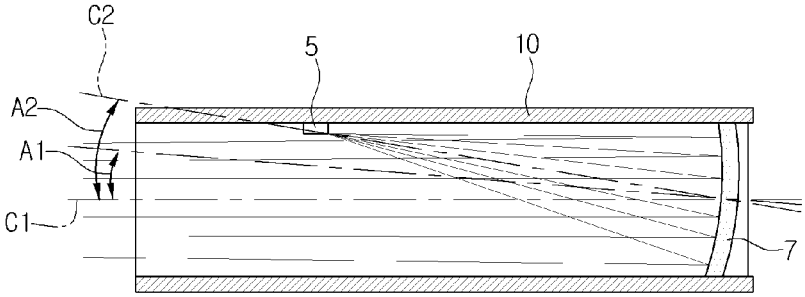
FIGS. 2A and 2B are conceptual diagrams illustrating a degree of parallax according to the position of a dot reticle generating unit.
Figure 2B:
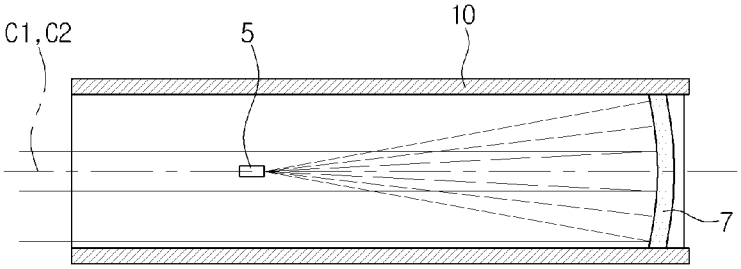
Figure 3:
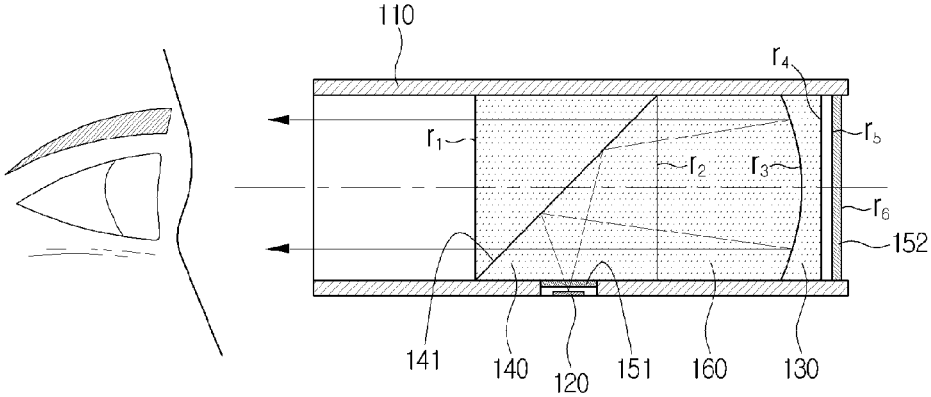
FIG. 3 is a schematic diagram illustrating a configuration of an exemplary dot-sighting device including a beam splitter according to a first embodiment.

FIG. 3 is a schematic diagram illustrating a dot-sighting device with a beam splitter according to a first embodiment.

Referring to FIG. 3, the dot-sighting device with the beam splitter according to the first embodiment includes a barrel 110 arranged on a gun in parallel with a gun barrel, a dot reticle generating unit 120 arranged on one side of an inner circumferential surface of the barrel 110, a reflective mirror 130 arranged inside the barrel 110 and in the front of the dot reticle generating unit 120, a beam splitter 140 that is arranged between the dot reticle generating unit 120 and the reflective mirror 130 in the optical path and includes an inclined plane 141 that reflects light of a dot reticle provided from the dot reticle generating unit 120 toward the reflective mirror 130 and transmits incident light which is reflected by the reflective mirror 130 and directed toward the beam splitter 140, and a first polarizing unit 151 arranged between the dot reticle generating unit 120 and the beam splitter 140, and a second polarizing unit 152 arranged in front of the reflective mirror 130.

The dot reticle generating unit 120 generates a dot reticle image or a dot mask image (hereinafter, referred to collectively as a "dot reticle image"). In order to generate a dot mask image, for example, the dot reticle generating unit 120 includes a light-emitting element such as a light-emitting diode (LED) and a mask including a light transmitting portion of a dot mask (reticle) shape positioned in front of the light-emitting element. The dot reticle generating unit 120 may be configured with an OLED, an LCD, an LCOS, or the like to display a dot reticle shape.

The reflective mirror 130 includes a flat concave lens (or a concave flat lens) having a negative refractive power having a single reflective plane that reflects the dot reticle of the dot reticle generating unit 120. The reflective mirror 130 may be connected with the beam splitter 140 through a connecting member 160 and provided in the form of a single module integrated with the beam splitter 140. Preferably, the connecting member 160 may be made of the same material as the reflective mirror 130 so that an external target and a surrounding area image which are seen through the beam splitter 140, the connecting member 160, and the reflective mirror 130 are neither magnified nor distorted.

The beam splitter 140 may be configured with a beam splitting prism in which two right-angled prisms are combined. In other words, 50% reflective coating is applied to one of two inclined planes 141 forming the boundary between the two right-angled prisms, and then the two right-angled prisms bond with each other, so that the beam splitter 140 that passes 50% and reflects 50% is formed. The dot reticle generating unit 120 is arranged on the lower side surface facing the inclined plane 141 of the beam splitter 140, and the reflective mirror 130 is arranged in the front. In this case, the optical axis of the reflective mirror 130 matches the optical axis of the dot reticle which is reflected by the inclined plane 141 of the beam splitter 140 and directed toward the reflective mirror 130. The beam splitter 140 may also be configured with a beam splitting plate which is obliquely arranged. When the beam splitter 140 is configured with a beam splitting plate, transmission and reflection coating may be applied on at least one surface of plate-like optical glass which is obliquely arranged according to a transmission amount of beam. In other words, when A % reflection coating is applied, the beam splitter 140 that transmits (100-A) % of incident light provided to the beam splitter 140 and reflects A % thereof is obtained.

The coating of the inclined plane 141 of the beam splitter 140 reflects light of the dot reticle provided from the dot reticle generating unit 120 toward the reflective mirror 130 and transmits light of the dot reticle reflected from the reflective mirror 130 toward the beam splitter 140, so that the light is formed on the user's retina as an image of the dot reticle. Further, light reflected from the external target pass through the reflective mirror 130 and the inclined plane 141 of the beam splitter 140 is formed on the user's retina as an image of the external target. In other words, the coating of the inclined plane 141 preferably includes at least one thin film formed such that transmittivity for each wavelength on the wavelength range (about 450 nm to 660 nm) of visible light has deviation of within about 30% from an average value of transmittivity for each wavelength when the user views the external target image and the dot reticle image in the overlapping manner so that the color of the external target does not significantly differ from the color of the external field of vision secured from the surrounding area.

Here, curvature radii of refractive surfaces through which light passes on an optical path from the target to the user's eye(s) are preferably decided so that a magnification Γ becomes 1 (one) in the following Formula (1):

$$r = \frac{M'}{M} \tag{1}$$

where, M'represents the size of an image formed on the user's retina by light which is reflected from the external target and passes through the reflective mirror 130 and the beam splitter 140, and M represents the size of an image formed on the user's retina when the user views the external target with a naked eye(s), that is, the size of an image formed on the user's retina by light reflected from the same external target in a state in which the reflective mirror 130 and the beam splitter 140 are not provided.

In other words, the curvature radii of refractive surfaces through which light passes on an optical path from the target to the user's eye(s) are decided such that M' is substantially equal to M.

Here, let us assume that an optical system (an optical system including the reflective mirror 130 and the beam splitter 140 in the present embodiment) having a refractive power D' (a reciprocal of a focal distance of a meter (m) unit) is provided in front of the user's eye(s). In this case, the size M' of the image of the external object formed on the user's retina through the optical system differs from the size M of the external object formed on the user's retina without the optical system. In optical science, the ratio $$\frac{M'}{M}$$

is referred to as a spectacle magnification $\Gamma_{sum}$, and can be approximated as in the following Formula (2):

$$\Gamma_{sm} = \frac{M'}{M} = \frac{1}{1 - \frac{l}{f'}} = \frac{1}{1 - l \times D'} \tag{2}$$

Here, a focal distance m of the optical system is $$f' \frac{1}{(D')},$$

and a distance m from the user's eye to an objective principal plane of the optical system is l. For example, in the example of FIG. 3, D' represents refractive power when light travels from the left to the right, and D represents refractive power when light travels the right to the left.

In other words, the spectacle magnification $\Gamma_{sum}$ in Formula (2) can be recognized to be the same as Γ of Formula (1).

When the size of a retina image on an external aiming target when a field of vision is secured through the dot-sighting device differs from the size of a retina image on an external aiming target secured when a field of vision is secured with the naked eye(s), the user feels fatigue on his/her eyes in a situation in which the user needs to view the external target while alternately securing a field of vision through the dot-sighting device and with the naked eye(s) in order to cope with rapid movement of the external aiming target.

For this reason, in the present embodiment, the spectacle magnification value of the dot-sighting device expressed in Formula (1) is adjusted to suppress the eye fatigue caused since the size of the external target image changes in a situation in which the user needs to view the external target while alternately securing a field of vision through the dot-sighting device and with the naked eye(s) in order to cope with rapid movement of the external aiming target.

To this end, the spectacle magnification preferably has a range of 0.985 to 1.015, and a change in the size of the external target image formed on the retina between the dot-sighting device is used and the dot-sighting device is not used is adjusted to be within about 1.5%.

Generally, when the difference between images formed on the retinas of the two eyes is within about 1.5%, the user can view an object with both eyes, but however, when the difference between images formed on the retinas of the two eyes is about 5% or more, it is difficult to view an object with both eyes, leading to a double vision. In other words, when the dot-sighting device is used, the user may view the external target with one eye through the dot-sighting device and with the other eye without the dot-sighting device, depending on movement of the external target. In this case, in order to prevent an aniseikonia that optically causes fatigue of the eyes, an allowable difference between images formed on the retinas of the two eyes is preferably within about 1.5%.

The spectacle magnification decided as described above can be applied to the dot-sighting device according to the present embodiment using the following Formula (3):

$$0.985 < \frac{M'}{M} = \frac{1}{1 - l \times D'} < 1.015 \tag{3}$$

As can be seen in Formula (3), the spectacle magnification is affected by a composite refractive power D' of the entire optical system obtained using a function of surface refractive powers of respective refractive surfaces as in the following Formula (4):

$$D' = f(D_1', D_2', D_3', \ldots) \tag{4}$$

The surface refractive power of each refractive surface is obtained by Formula (5):

$$D_i' = \frac{n_i' - n_i}{r_i}, \tag{5}$$

where $r_i$ is a curvature radius (here, a unit is meter) of an i-th refractive surface, $n_i'$ is a refractive index of a space after passing through the i-th refractive surface, and $n_i$ is a refractive index of a space before passing through the i-th refractive surface. In other words, for example, n3' is a refractive index of the space at the right side of the refractive surface corresponding to r3, and n3 is a refractive index of the space at the left side of the refractive surface corresponding to r3.

When a refractive surface is a plane, $r_i$ is infinite ($r_i = \infty$), the surface refractive power of Formula (5) becomes zero, and the refractive power D' of the entire the optical system in Formula (4) becomes zero. In this case, the spectacle magnification $\Gamma_{sm}$ in Formula (2) becomes 1 (one) ($\Gamma_{sm} = 1$), the size of the external target formed on the user's retina by light passing through the reflective mirror 130 and the beam splitter 140 is substantially the same as the size of the external target formed on the user's retina by light reflected from the external target without the reflective mirror 130 and the beam splitter 140.

Further, all refractive surfaces through which light reflected from the external target the surrounding area passes while passing through the reflective mirror 130 and the beam splitter 140 before being incident to the user's eye(s) have an infinite curvature radius, or the spaces before and after (or between) the refractive surfaces have the same refractive index. Thus, since there is no refractive power, magnification of one (1) is applied. In other words, all refractive surfaces r1 to r6 have the surface refractive power of zero (0) in Formula (5), the spectral magnification in Formula (2) substantially becomes one (1).

Meanwhile, the first polarizing unit 151 is arranged between the dot reticle generating unit 120 and the beam splitter 140, and the second polarizing unit 152 is arranged in front of the reflective mirror 130. The first polarizing unit 151 and the second polarizing unit 152 may be configured with linear polarizers having polarization directions perpendicular to each other. The dot reticle that has passed through the first polarizing unit 151 is blocked by the second polarizing unit 152 arranged in front of the reflective mirror 130, and thus the dot reticle is not seen from the target side.

Next, an operation of the dot-sighting device with the beam splitter according to the first embodiment will be described.

Referring to FIG. 3, dot reticle light emitted from the dot reticle generating unit 120 is converted into linearly polarized light through the first polarizing unit 151, reflected by the inclined plane 141 of the beam splitter 140 according to reflectivity of the inclined plane 141, and then directed toward the reflective mirror 130.

Then, the dot reticle light is reflected by the reflective mirror 130, passes through the inclined plane 141 of the beam splitter 140 according to transmittivity of the inclined plane 141, and is then incident to the user's eye(s), so that the user views the dot reticle image.

Meanwhile, the dot reticle light that moves toward the target after passing through the reflective mirror 130 may be seen by the opponent party around the target. However, since the second polarizing unit 152 having a polarization axis perpendicular to the first polarizing unit 151 is arranged in front of the reflective mirror 130, the dot reticle light that has passed through the first polarizing unit 151 is blocked by the second polarizing unit 152, and the dot reticle light that moves toward the target after passing through the reflective mirror 130 is not seen by the opponent party around the target, and the position of the user of the dot-sighting device is not exposed to the opponent party.

In the first embodiment, the optical axis of the reflective mirror 130 matches an axis of light that is reflected from or passes through the inclined plane 141 of the beam splitter 140, that is, the reflective mirror 130 need not obliquely be arranged. Thus, parallax of light passing through the beam splitter 140 can be minimized. Thus, even when the reflective mirror 130 having a single reflective surface is employed, excellent performance can be guaranteed, and since the distance between the dot reticle generating unit 120 and the reflective mirror 130 can be reduced, a light-weight, compact dot-sighting device can be manufactured.

The present embodiment has been described in connection with the example in which the dot-sighting device includes the beam splitter 140, the first polarizing unit 151, and the second polarizing unit 152. However, the dot-sighting device may not include the first polarizing unit 151 and the second polarizing unit 152 when it is not problematic that the position of the user is exposed to the opponent party. In this case, there is an effect by which the distance between the target generating unit 120 and the reflective mirror 130 is reduced.

For example, an LED emitting light having a wavelength of 650 nm is used as a light source of the dot reticle generating unit 120, and one or more coating layers having transmittivity of 50% and reflectivity of 50% for each wavelength on a wavelength range (about 450 nm to 660 nm) of visible light are formed on the inclined plane of the beam splitter 140. Then, one or more coating layers that reflect light having a wavelength of 650 nm±10 nm (reflects almost 50% in the wavelength of 650 nm) but hardly reflects the other wavelength range of the visible light are formed on the reflective surface of the reflective mirror 130. In this case, when the dot reticle light is reflected by the inclined plane 141 of the beam splitter 140, reflected by the reflective mirror 130 again, passes through the inclined plane 141 of the beam splitter 140, and incident to the user's eye(s), final transmittivity is about 12.5%. Thus, when light reflected from the external target passes through the reflective mirror 130 and the inclined plane 141 of the beam splitter 140, and is then incident to the user's eye(s), the light undergoes transmittivity of about 50% on the entire wavelength range of the visible light, and thus the color of the field of vision secured from the external target and the surrounding area does not significantly changes. In other words, the coating layer formed on the reflective surface of the reflective mirror 130 is formed to reflect part of the wavelength band on the spectrum of the wavelength range of the visible light including the wavelength of the light source of the dot reticle generating unit 120. Thus, the color of the field of vision secured from the external target and the surrounding area after passing through the reflective mirror 130 and the inclined plane 141 of the beam splitter 140 does not significantly changes. As described above, the color of the field of vision secured from the external target and the surrounding area does not significantly changes when transmittivity for each wavelength on the wavelength range (about 450 nm to 660 nm) of visible light has deviation of within about 30% from an average value of transmittivity for each wavelength.

Next, a dot-sighting device with a beam splitter according to a second embodiment will be described.

Figure 4:
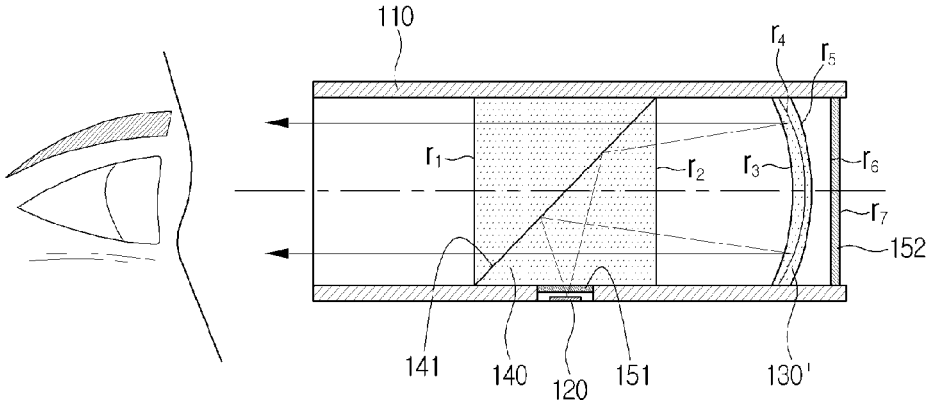
FIG. 4 is a schematic diagram illustrating a configuration of an exemplary dot-sighting device including a beam splitter according to a second embodiment.

FIG. 4 is a schematic diagram illustrating the dot-sighting device with a beam splitter according to the second embodiment.

Referring to FIG. 4, the dot-sighting device with the beam splitter according to the second embodiment differs from the dot-sighting device with the beam splitter according to the first embodiment in that a reflective mirror 130' includes a singlet or doublet lens, and the connecting member 160 is not arranged between the reflective mirror 130' and the beam splitter 140.

When the reflective mirror 130' is configured with a doublet lens including two lenses having the same refractive index ($n_3'=n_4=n_4'=n_5$) as illustrated in FIG. 4, a second surface (r4 in FIG. 4) of the reflective mirror 130' is configured as a reflective surface, and curvature radii of r3 and r5 are adjusted so that the external target image observed through the reflective mirror 130' has a magnification of 1. Here, the second surface r4 of reflective mirror 130' functions as not only a reflective surface reflecting the dot reticle light but also the refractive surface refracting light from the external target and the surrounding area.

Meanwhile, the reflective mirror is configured with a singlet lens, one of first and second surfaces of the singlet lens is configured as a reflective surface, and a curvature radius of the other surface is adjusted so that the external target image observed through the reflective mirror 130' has not a magnification.

Among refractive surfaces through which light reflected from the external target and the surrounding area passes while passing through the reflective mirror 130' and the beam splitter 140 before being incident to the user's eye(s), refractive surfaces r1, r2, r6, and r7 have an infinite curvature radius, and spaces before and after passing through the refractive surface r4 have the same refractive index ($n_4=n_4'$), and thus the refractive surface r4 substantially has no refractive power. Thus, the refractive surfaces r3 and r5 have the refractive power, and the surface refractive powers of the refractive surfaces r3 and r5 are represented by Formula (5) as follows:

$$D_3' = \frac{(n_3' - n_3)}{r_3}$$

$$D_5' = \frac{(n_5' - n_5)}{r_5}$$

The composite refractive power D' is represented by Formula (6) as follows:

$$D' = D_3' + D_5' - \frac{t_{35}}{n_5} D_3' \times D_5', \tag{6}$$

t35 represents the distance of the center of the lens from r3 and r5.

Here, in order to have the magnification in Formula (1) or (2) to be one (1), the composite refractive power D' in Formula (6) substantially becomes zero (0).

For example, in the dot-sighting device according to the second embodiment, let us assume that r3(*m*) of −0.115366 and r5(*m*) of −0.116556 are used as design data.

At this time, when the refractive index of the used reflective mirror lens 130' is 1.515013 ($n_3'=n_4=n_4'=n_5=1.515013$) at the wavelength of 635 nm of the dot reticle light and the space around the reflective mirror is the air, $n_3=n_5'=1.00$, and when the thickness t35 of the center of the reflective mirror lens 130' is 0.0035 m, the surface refractive power is obtained by Formula (5) as follows:

$$D_3' = \frac{(1.515013 - 1.000000)}{-0.115366} \approx -4.464166219$$

$$D_5' = \frac{(1.000000 - 1.515013)}{-0.116556} \approx 4.41858849$$

The composite refractive power D' is obtained by Formula (6) as follows:

$$D' = (-4.464166219) + (4.41858849) - \frac{0.0035}{1.515013}(-4.464166219) \times (4.41858849) = \approx -0.0000$$

Thus, the magnification in Formula (1) or (2) substantially becomes one (1).

Further, even when the reflective mirror 130' is configured with a doublet lens including two lenses having different refractive indices ($n_3'=n_4\neq n_4'=n_5$) in the structure illustrated in FIG. 4, the second surface (r4 in FIG. 4) of the reflective mirror 130' is configured as a reflective surface, and curvature radii of r3 and r5 are adjusted so that the external target image observed through the reflective mirror 130' has a magnification of 1. Among refractive surfaces through which light reflected from the external target and the surrounding area passes while passing through the reflective mirror 130' and the beam splitter 140 before being incident to the user's eye(s), refractive surfaces r1, r2, r6, and r7 have an infinite curvature radius, and spaces before and after passing through the refractive surface r3, r4, and r5 have different refractive indices. Thus, the refractive surfaces r3, r4, and r5 have the refractive power, and the surface refractive powers of the refractive surfaces r3 and r5 are represented by Formula (5) as follows:

$$D_3' = \frac{(n_3' - n_3)}{r_3}$$

$$D_4' = \frac{(n_4' - n_4)}{r_4}$$

$$D_5' = \frac{(n_5' - n_5)}{r_5}$$

The composite refractive power D' is represented using a function of $D_3'$, $D_4'$, $D_5'$ as in Formula 7 more complicated than Formula 6.

$$D'=f(D_3',D_4',D_5') \tag{7}$$

Here, in order to obtain the magnification of 1 in Formula (1) or (2), the value of Formula (7) has to substantially become zero (0).

However, when the spectral magnification has the range of Formula (3), fatigue of the eye(s) does not appear, and thus the dot-sighting device may be configured to have the surface refractive power having the spectral magnification of the range of Formula (3) may be allowed.

Meanwhile, the optical path through which the dot reticle emitted from the dot reticle generating unit 120 moves toward the user, the first polarizing unit 151, the second polarizing unit 152, and the operation of the dot-sighting device are similar to the first embodiment, and thus a redundant description will not be repeated.

As described above, when the reflective mirror 130 is configured with a singlet or doublet lens, parallax can be reduced to be smaller than in the first embodiment.

Next, a dot-sighting device with a beam splitter according to a third embodiment will be described.

Figure 5:
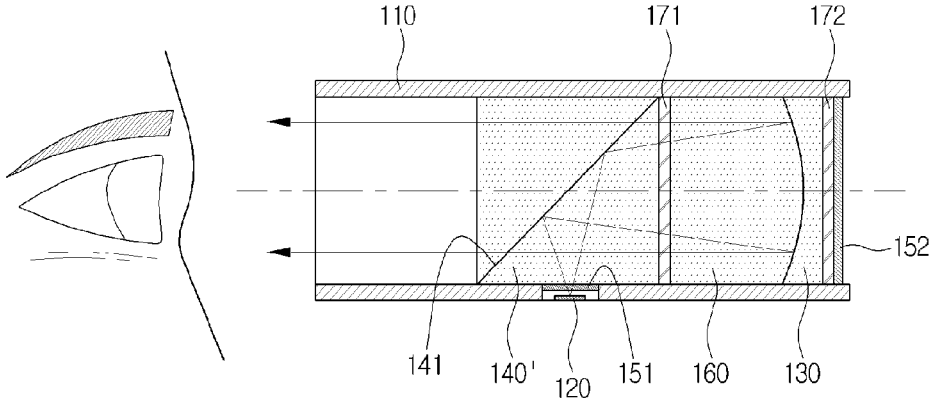
FIG. 5 is a schematic diagram illustrating a configuration of an exemplary dot-sighting device including a beam splitter according to a third embodiment.

FIG. 5 is a schematic diagram a dot-sighting device with a beam splitter according to a third embodiment.

Referring to FIG. 5, the dot-sighting device with the beam splitter according to the third embodiment differs from the first embodiment in that a beam splitter 140' is configured with a polarization beam splitting (PBS) prism, a first λ/4 plate (quarter wave plate) 171 is arranged between the beam splitter 140' and the reflective mirror 130, and a second λ/4 plate 172 is arranged in front of the reflective mirror 130.

In the beam splitter 140' configured with the PBS prism, a coating layer that reflects an s-polarized component of light and transmits a p-polarized component of light is formed on the inclined plane 141. The first polarizing unit 151 arranged between the dot reticle generating unit 120 and the beam splitter 140' has a polarization axis set to convert light emitted from the dot reticle generating unit 120 into s-polarized light.

In other words, the dot reticle light emitted from the dot reticle generating unit 120 is converted into s-polarized light through the first polarizing unit 151, and the s-polarized light is reflected by the inclined plane 141 of the beam splitter 140' and then directed toward the first λ/4 plate 171. The s-polarized light is converted into right-handed circularly polarized light (or left-handed circularly polarized light) through the first λ/4 plate 171. Then, the s-polarized light is reflected by the reflective mirror 130 and then converted into p-polarized light while passing through the first λ/4 plate 171 again. Then, the p-polarized light passes through the inclined plane 141 of the beam splitter 140' and is then directed toward the user.

Next, an operation of the dot-sighting device with the beam splitter according to the third embodiment will be described.

Referring to FIG. 5, the dot reticle light emitted from the dot reticle generating unit 120 is converted into s-polarized light while passing through the first polarizing unit 151 and then incident to the beam splitter 140'. The reflective surface of the beam splitter 140' reflects the dot reticle light toward the reflective mirror 130 since the dot reticle light is converted into the s-polarized light.

The dot reticle light having the s-polarized component directed from the inclined plane 141 to the reflective mirror 130 is converted into right-handed circularly polarized light (or left-handed circularly polarized light). Part of the right-handed circularly polarized light (or left-handed circularly polarized light) passes through the reflective mirror 130 and is directed toward the external target, and other part of the right-handed circularly polarized light (or left-handed circularly polarized light) is reflected by the reflective mirror 130, converted into left-handed circularly polarized light (or right-handed circularly polarized light) due to the reflection, and then directed toward the beam splitter 140'.

The dot reticle light reflected by the reflective mirror 130 is converted into p-polarized light while passing through the first λ/4 plate 171 arranged between the connecting member 160 and the beam splitter 140', and then passes through the inclined plane 141 of the beam splitter 140'. Thus, the user can aim the external target while matching the dot reticle image which is emitted from the dot reticle generating unit 120 and then reflected by the reflective mirror 130 with the external target viewed through the beam splitter 140'.

Meanwhile, since light passing through the reflective mirror 130 is right-handed circularly polarized light (or left-handed circularly polarized light) converted by the first λ/4 plate 171, the right-handed circularly polarized light (or left-handed circularly polarized light) does not pass through the second λ/4 plate 172 and the second polarizing unit 152 which are configured to transmit circularly polarized light opposite to circularly polarized light converted by the first polarizing unit 151 and the first λ/4 plate 171, that is, left-handed circularly polarized light (or right-handed circularly polarized light). Thus, even when the optical axis of the reflective mirror 130 is on the same line as the optical axis of the beam splitter 140', the dot reticle light emitted from the dot reticle generating unit 120 does not pass through the second polarizing unit 152, and it is possible to prevent the position of the user from being exposed to the opponent party since the dot reticle light is viewed by the opponent party around the target.

According to the third embodiment, since there is no loss of light in the beam splitter 140', the vivid dot reticle can be provided to the user. In addition, even when the dot reticle light passes through the reflective mirror 130, the dot reticle light hardly passes through the second λ/4 plate 172 and the second polarizing unit 152 in front of the reflective mirror 130, and the opponent part at the target side hardly views the dot reticle light.

Figure 6:
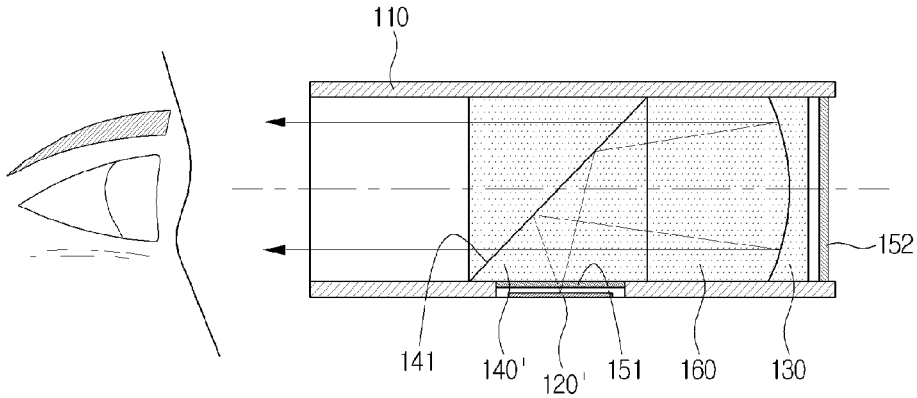
FIG. 6 is a schematic diagram illustrating a configuration of an exemplary dot-sighting device including a beam splitter according to a fourth embodiment.

FIG. 6 is a schematic diagram illustrating a dot-sighting device with a beam splitter according to a fourth embodiment.

Referring to FIG. 6, the dot-sighting device with the beam splitter according to the fourth embodiment differs from the first embodiment in that a dot reticle generating unit 120' includes a display unit providing or displaying a video or an image such as an LCOS, an LCD, or an OLED.

In other words, when the dot reticle generating unit 120' is configured with the display unit, the display unit provides or displays video or image information desired by the user together with the dot reticle, and the video or image information is reflected by the reflective mirror 130, so that the dot reticle and the video or image information can be simultaneously projected toward the user. More specifically, an imaging element including an image sensor such as a CCD type image sensor or a CMS type image sensor or a thermal imaging apparatus may be attached to the dot-sighting device. An image or video captured by the imaging element or the thermal imaging apparatus is transferred to the image providing element, and thus the user can view the image or video related to an area around the external target together with the dot reticle image.

Figure 7:
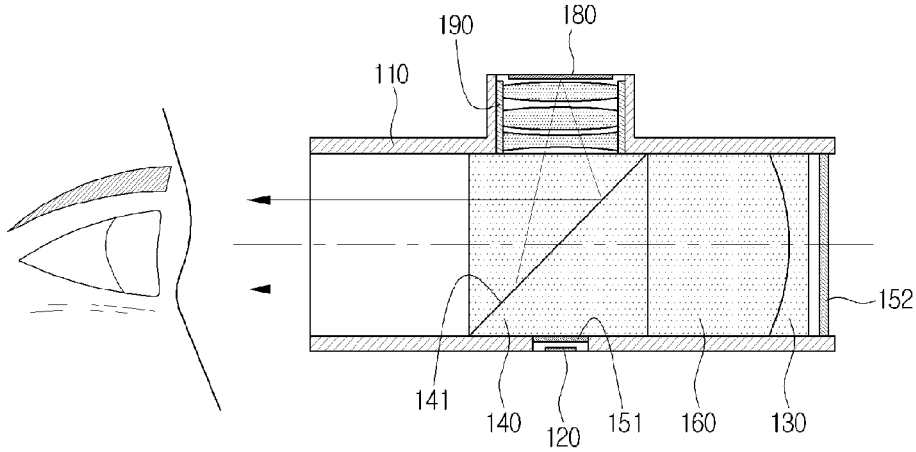
FIGS. 7 and 8 are schematic diagrams illustrating a configuration of an exemplary dot-sighting device including a beam splitter according to a fifth embodiment.

FIG. 7 is a schematic diagram illustrating a dot-sighting device with a beam splitter according to a fifth embodiment.

Referring to FIG. 7, the dot-sighting device with the beam splitter according to the fifth embodiment differs from the fourth embodiment in that a display unit 180 and a video enlarging optical system 190 are additionally arranged. The display unit 180 includes an LCOS, an LCD, an OLED, or the like, is arranged at the other side of the inner circumferential surface of the barrel 110 (the side opposite to the dot reticle generating unit), and provides a video or an image toward the inclined plane 141 of the beam splitter 140. The video enlarging optical system 190 is arranged between the display unit 180 and the beam splitter 140, and enlarges a video or an image while reducing eye fatigue by causing a video or an image provided from the display unit 180 to be formed on the user's retina as a virtual image of a video or an image at a distance farther than a reduced distance according to the optical path up to the display unit 180.

In other words, when it is difficult to use the dot reticle, for example, at night, a video or an image acquired by a CCD image sensor, an infrared (IR) CCD image sensor, a thermal imaging apparatus, an IR image sensor, or the like can be provided through the display unit 180. A video or an image provided through the display unit 180 is enlarged at a distance farther than a reduced distance according to the optical path up to the display unit 180 through the video enlarging optical system 190 and then observed by the user, the user's eye fatigue can be reduced.

Figure 8:
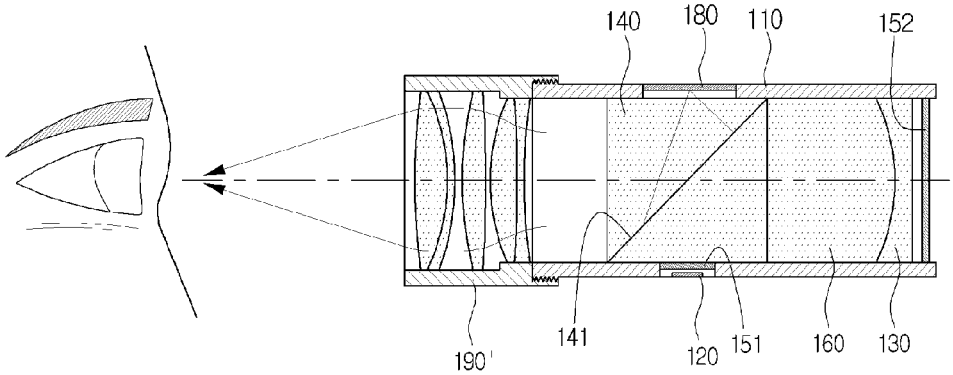

Further, the video enlarging optical system 190 may be configured to be removably attached to the dot-sighting device. For example, as illustrated in FIG. 8, in a state in which the display unit 180 is installed at the other side of the inner circumferential surface of the barrel, the video enlarging optical system 190 may be removably attached to an end portion of the barrel 110, at the user side, between the beam splitter 140 and the user.

Although not shown, a video enlarging optical system 190 may be configured to include a plurality of lens groups. In this case, according to a use environment thereof, some of the plurality of lens groups may be arranged between the display unit 180 and the beam splitter 140, and the remaining lens groups may be arranged at the end portion of the barrel 110 at the user side.

The third to fifth embodiments have been described in connection with the example, the connecting member 160 and the reflective mirror 130 according to the first embodiment are employed. However, the connecting member 160 may not be arranged as in the second embodiment, or the reflective mirror may be configured with a singlet or doublet lens.

The preferred embodiments have been described above with reference to the accompanying drawings, whilst the present invention is not limited to the above examples, of course. A person skilled in the art may find various alternations and modifications within the scope of the appended claims, and it should be understood that they will naturally come under the technical scope of the present invention.

Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

Words of comparison, measurement, and time such as "at the time," "equivalent," "during," "complete," and the like should be understood to mean "substantially at the time," "substantially equivalent," "substantially during," "substantially complete," etc., where "substantially" means that such comparisons, measurements, and timings are practicable to accomplish the implicitly or expressly stated desired result.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A dot-sighting device, comprising:

a housing having a first opening and a second opening, an optical axis being defined as a straight line from the first opening to the second opening;

a light source that emits light;

a beam splitter that includes a surface that reflects at least a portion of a first light component of the light and transmits at least a portion of a second light component; and a reflective element that reflects at least a portion of the first light component reflected by the surface of the beam splitter toward the beam splitter, the reflective element being disposed on the optical axis, wherein the light reflected by the reflective element includes the second light component.

2. The dot-sighting device according to claim 1, further comprising a first light converting unit that converts the light emitted from the dot image generating unit into the first light component.

3. The dot-sighting device according to claim 2, further comprising a second light converting unit that blocks at least a portion of light passing through the reflective element.

4. The dot-sighting device according to claim 1, further comprising a connecting member that is arranged between the beam splitter and the reflective element, wherein the connecting member and the beam splitter are made from a same material.

5. The dot-sighting device according to claim 1, wherein a ratio of a size of an image observed through the dot-sighting device to a size of an image observed without the dot-sighting device is in a range of from 0.985 to 1.015.

6. The dot-sighting device according to claim 1, wherein an optical system of the dot-sighting device has a composite refractive power of substantially zero.

7. The dot-sighting device according to claim 1, wherein an optical system of the dot-sighting device has a spectacle magnification between 0.985 and 1.015.

8. The dot-sighting device according to claim 1, wherein the light emitted from the light source includes a dot reticle image or a dot mask image.

9. The dot-sighting device according to claim 1, further comprising a display unit that displays video or image information, wherein the surface of the beam splitter reflects the video or image information provided from the display unit.

10. The dot-sighting device according to claim 9, further comprising an image sensor that images a subject and provides a subject image to the display unit, wherein the display unit displays the subject image from the image sensor.

11. The dot-sighting device according to claim 9, further comprising a thermal imaging apparatus that images a subject and provides a subject image to the display unit, wherein the display unit displays the subject image from the thermal imaging apparatus.

12. The dot-sighting device according to claim 1, wherein the reflective element includes a singlet lens or a doublet lens.

13. The dot-sighting device according to claim 1, wherein the reflective element includes a flat concave lens.

14. The dot-sighting device according to claim 1, wherein an optical axis of the beam splitter is parallel to an optical axis of the reflective element.

15. The dot-sighting device according to claim 1, wherein the beam splitter includes a polarization beam splitting (PBS) prism.

16. A dot-sighting device, comprising:

a light source that emits light;

a beam splitter that includes a surface that reflects at least a portion of a first light component of the light and transmits at least a portion of a second light component;

a reflective element that reflects at least a portion of the first light component reflected by the surface of the beam splitter toward the beam splitter;

a first light converting unit that converts the light emitted from the dot image generating unit into the first light component; and a second light converting unit that blocks at least a portion of light passing through the reflective element, wherein the light reflected by the reflective element includes the second light component, and the first light converting unit and the second light converting unit include linear polarizers that have polarization directions perpendicular to each other.

17. A dot-sighting device, comprising:

a light source that emits light;

a beam splitter that includes a surface that reflects at least a portion of a first light component of the light and transmits at least a portion of a second light component; and a reflective element that reflects at least a portion of the first light component reflected by the surface of the beam splitter toward the beam splitter;

a third light converting unit that is arranged between the beam splitter and the light source; and a fourth light converting unit that has a polarization direction opposite to a polarization direction of the third light converting unit and is arranged to block light passing through the reflective element, wherein the light reflected by the reflective element includes the second light component.

18. The dot-sighting device according to claim 17, wherein the third and fourth light converting units are circular polarizers.

19. A dot-sighting device, comprising:

a housing having a first opening and a second opening, an optical axis being defined as a straight line from the first opening to the second opening;

a light source that emits light;

a reflective element that reflects light, the reflective element being disposed on the optical axis; and an optical system that reflects at least a portion of the light emitted from the light source and transmits at least a portion of the light reflected by the reflective element.

20. The dot-sighting device according to claim 19, wherein the dot-sighting device has a spectacle magnification in a range of from 0.985 and 1.015.

21. The dot-sighting device according to claim 19, further comprising a display unit that displays video or image information; and an imaging apparatus that images a subject and provides a subject image to the display unit, wherein the display unit displays the subject image from the imaging apparatus, and the optical system reflects the subject image.

22. The dot-sighting device according to claim 19, wherein a second optical axis is defined by the optical system, and the second optical axis is substantially parallel to the optical axis defined from the first opening to the second opening of the housing.

* * * * *